US005465867A

United States Patent [19]

Yown

[11] Patent Number: 5,465,867

[45] Date of Patent: Nov. 14, 1995

[54] LITTER BIN

[76] Inventor: Robert Yown, P.O. Box 82-144, Taipei, Taiwan

[21] Appl. No.: 294,246

[22] Filed: Aug. 22, 1994

[51] Int. Cl.[6] ..... B65D 25/20

[52] U.S. Cl. ..... 220/735; 220/694

[58] Field of Search ..... 220/735, 736, 220/23.83, 908, 694, 23.4

[56] References Cited

U.S. PATENT DOCUMENTS

| | | | |
|---|---|---|---|
| 1,060,048 | 4/1913 | Wetzel | 220/735 |
| 2,390,874 | 12/1945 | Endebrock | 220/735 |
| 3,659,369 | 5/1972 | Hermanson | 220/735 |
| 4,995,526 | 2/1991 | Garrison | 220/735 |
| 5,148,932 | 9/1992 | Orefice | 220/23.83 |
| 5,195,648 | 3/1993 | Harris | 220/908 |
| 5,322,179 | 6/1994 | Ting | 220/908 |

*Primary Examiner*—Stephen J. Castellano
*Attorney, Agent, or Firm*—Alfred Lei

[57] ABSTRACT

A litter bin including a container formed with a pair of lugs each having a center opening, an upper hole above the center opening, a lower hole below the center opening, and an intermediate hole located between the upper hole and the lower hole, and a tape holder having a pair of upwardly extending arms and a seat at a lower portion, the arms each having a cylindrical portion adapted to engage the center opening of each of the lugs and a protuberance located under the cylindrical portion and engageable with the upper hole, the intermediate hole and the lower hole of each of the lugs.

2 Claims, 9 Drawing Sheets

LITTER BIN

BACKGROUND OF THE INVENTION

Many litter bins have been developed to collect trash, candy wrappers, napkins, empty cigarette packages, leaves, grass and the like. However, plastic bags which are harmful to the environment must be used with these litter bins in order to keep it clean and sanitary thereby making it unsuitable for environmental protection.

Therefore, it is an object of the present invention to provide an improved litter bin which can obviate and mitigate the above-mentioned drawbacks.

SUMMARY OF THE INVENTION

This invention relates to an improved litter bin.

It is the primary object of the present invention to provide a litter bin which can be used to make litter bags from waste paper.

It is another object of the present invention to provide a litter bin which is fit for environmental protection.

It is still another object of the present invention to provide a litter bin which is simple in construction.

It is still another object of the present invention to provide a litter bin which is low in cost.

It is a further object of the present invention to provide a litter bin which is facile to manufacture.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
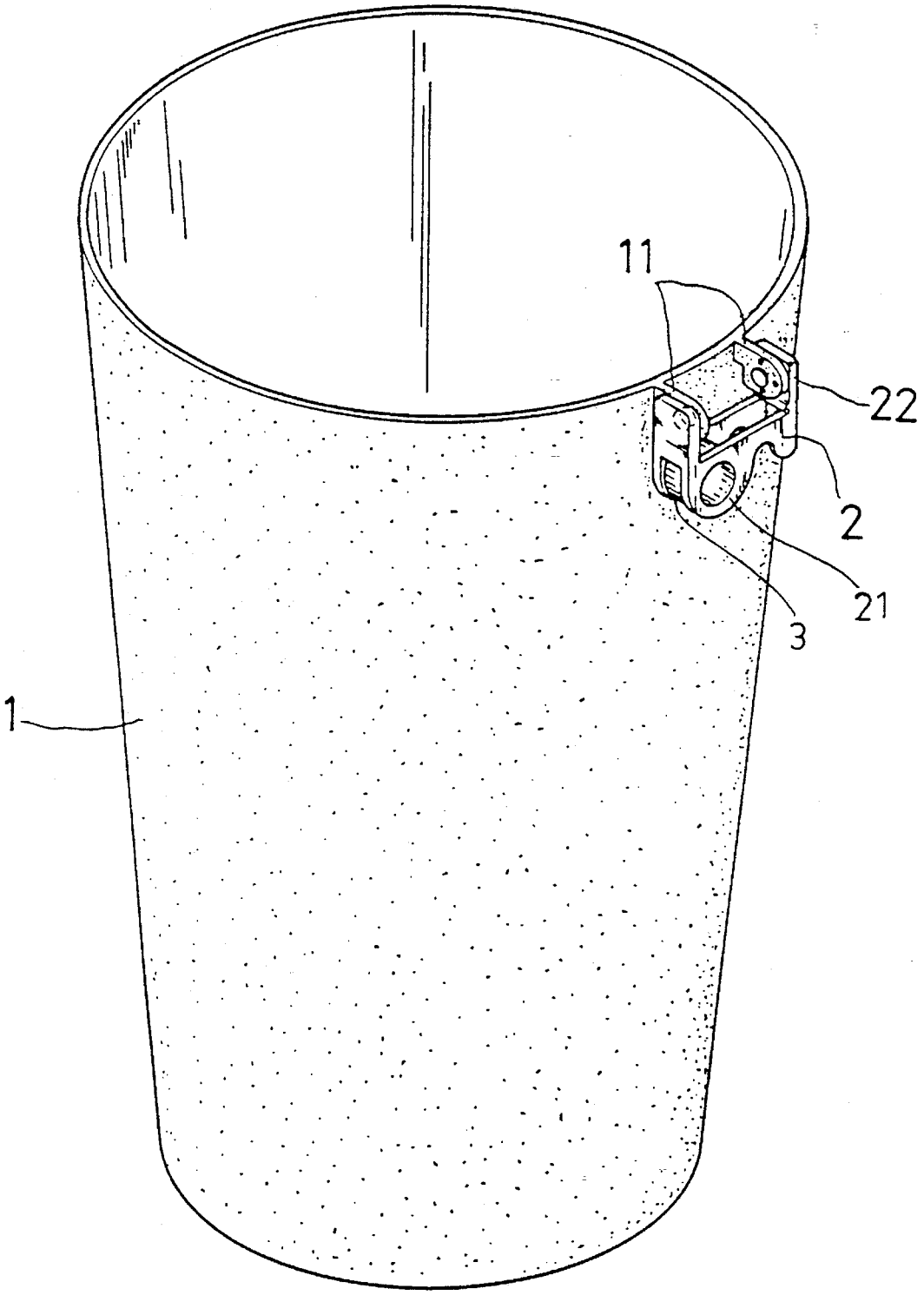
FIG. 1 is a perspective view of the present invention.
Figure 2:
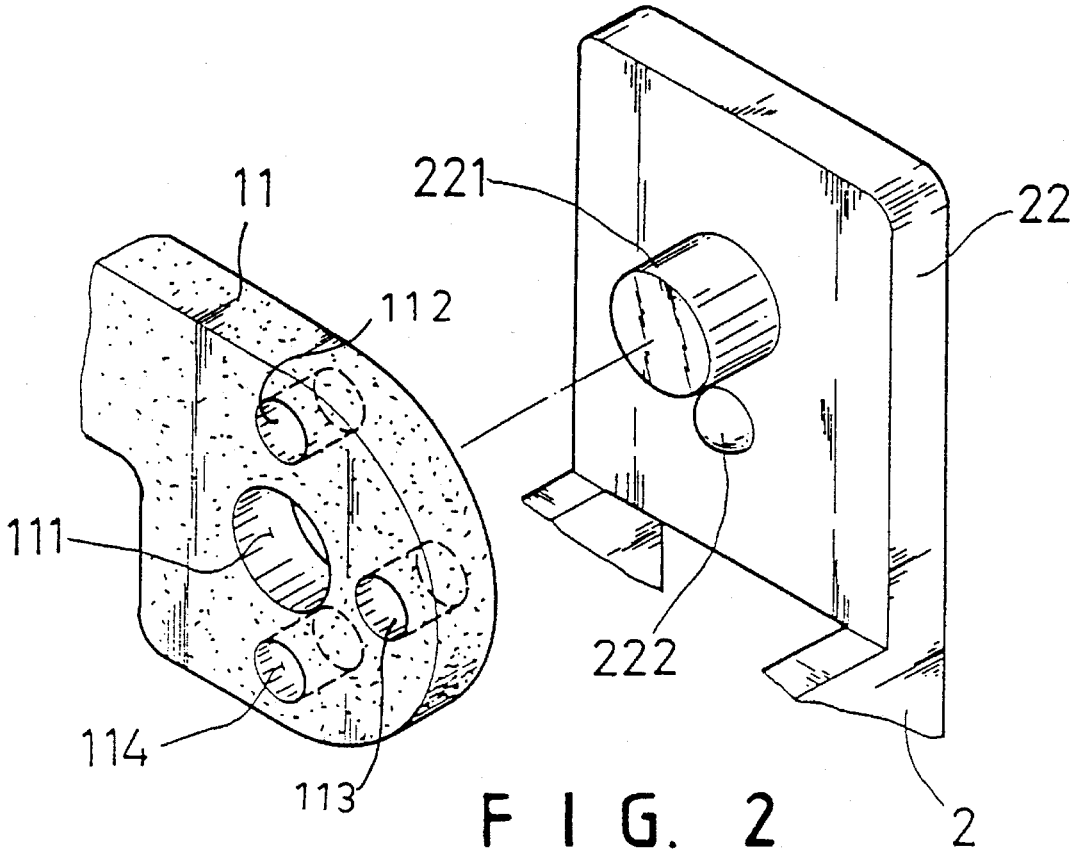
FIG. 2 is an enlarged fragmentary view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 9:
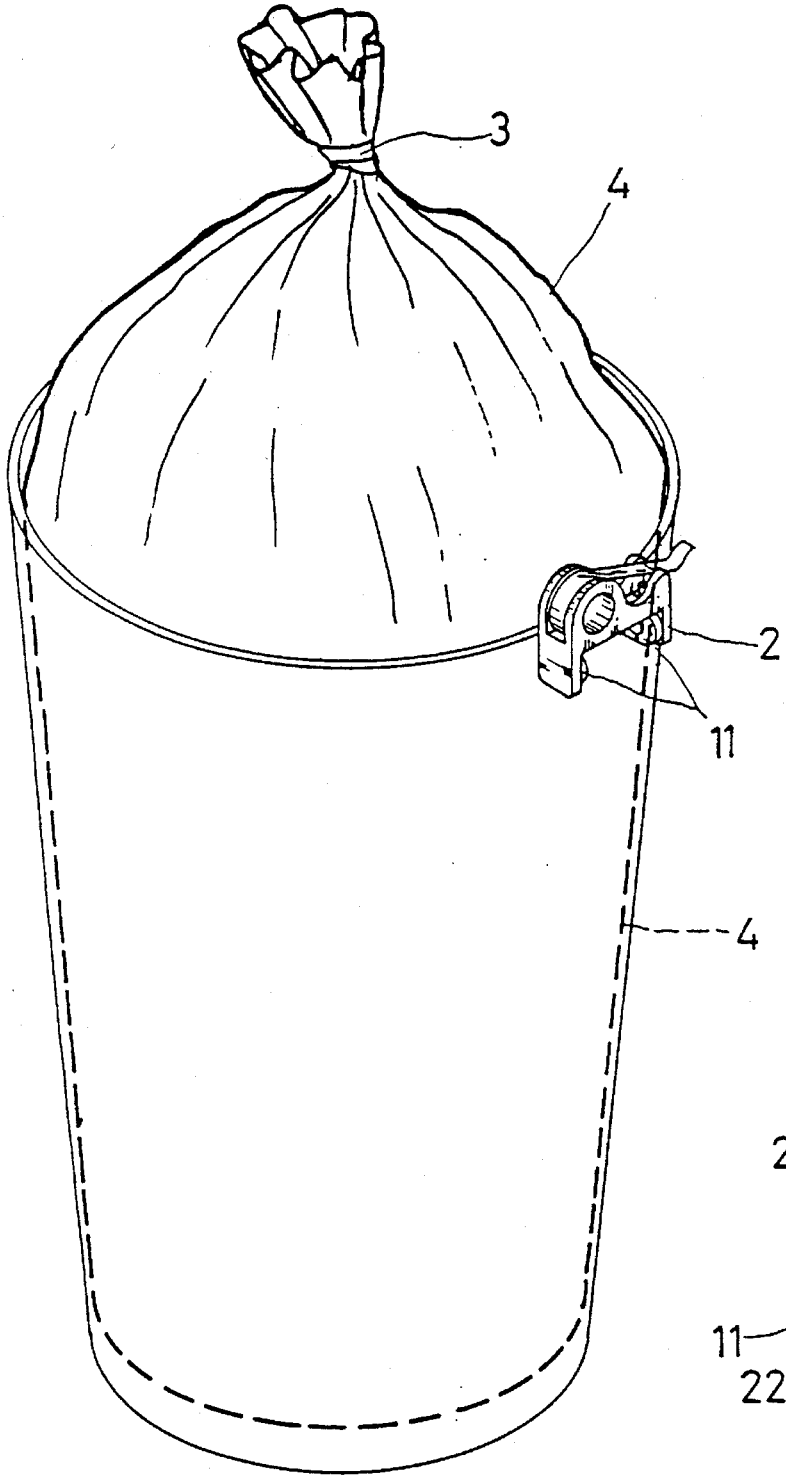
Figure 10:
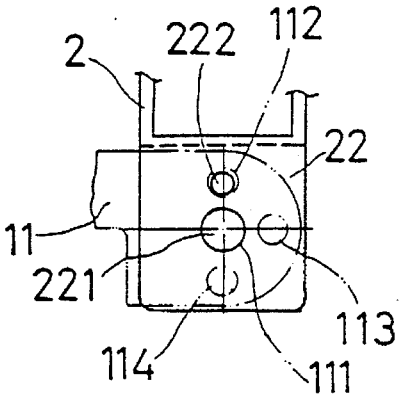

With reference to the drawings and in particular to FIGS. 1, 2, 5, 7 and 10, the litter bin according to the present invention comprises a container 1 formed with a pair of lugs 11 at the upper portion. Each of the lugs 11 has a center opening 111, an upper hole 112 above the center opening 111, a lower hole 113 below the center opening 111, and an intermediate hole 113 between the upper hole 112 and the lower hole 113 and located at an outer side of the center opening 111. A tape holder 2 is pivotally mounted on the lugs 11 of the container 1 and has an upwardly extending arms 22 at both sides and a seat 21 at the lower portion. The seat 21 is used receive a roller of tape 3. Beside the seat 21 there is a cutter (not shown). The arm 22 has a cylindrical portion adapted to be received in the center opening 111 of the lug 11 so that the arm 22 of the tape holder 2 is pivotally connected with the lugs 11 of the container 1. Further, the arm 22 is formed below the cylindrical portion 221 with a protuberance 222 which will engage with the upper hole 112 when rotated to an upper position (see FIG. 9), engage the intermediate hole 113 when rotated to align with the lug 11 (see FIG. 4), and engage the lower hole 114 when rotated to a lower position (see FIG. 5).

Figure 3:
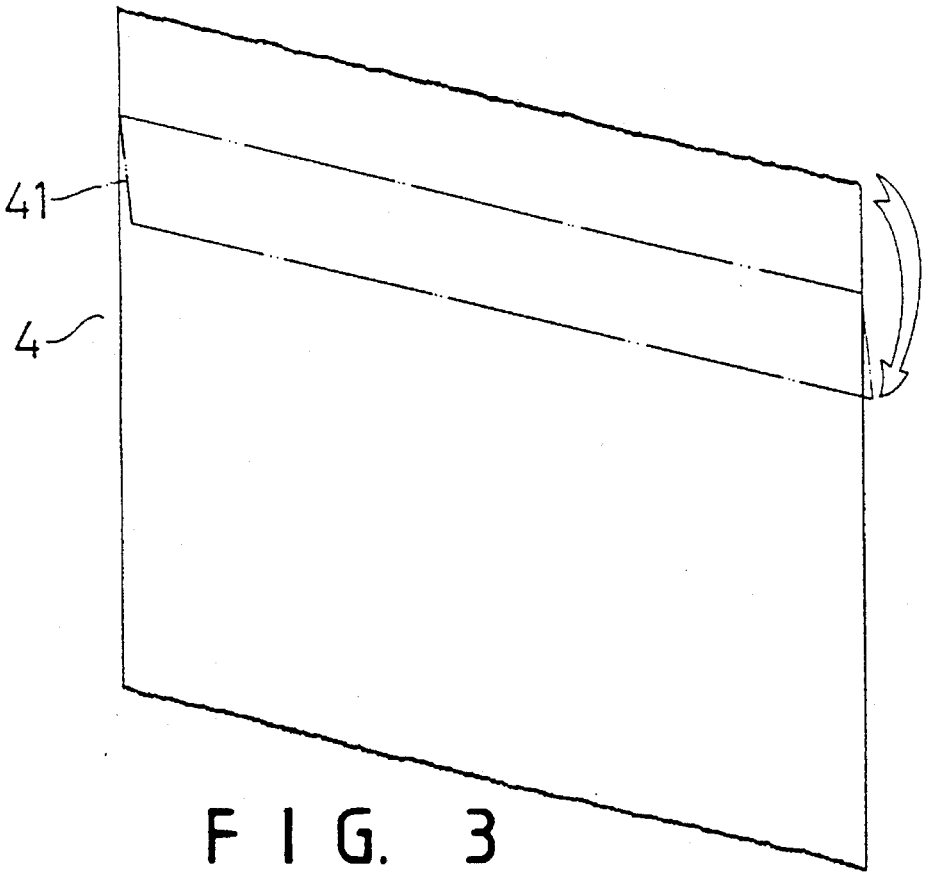
FIG. 3 shows the way to fold the waste paper sheet.
Figure 4:
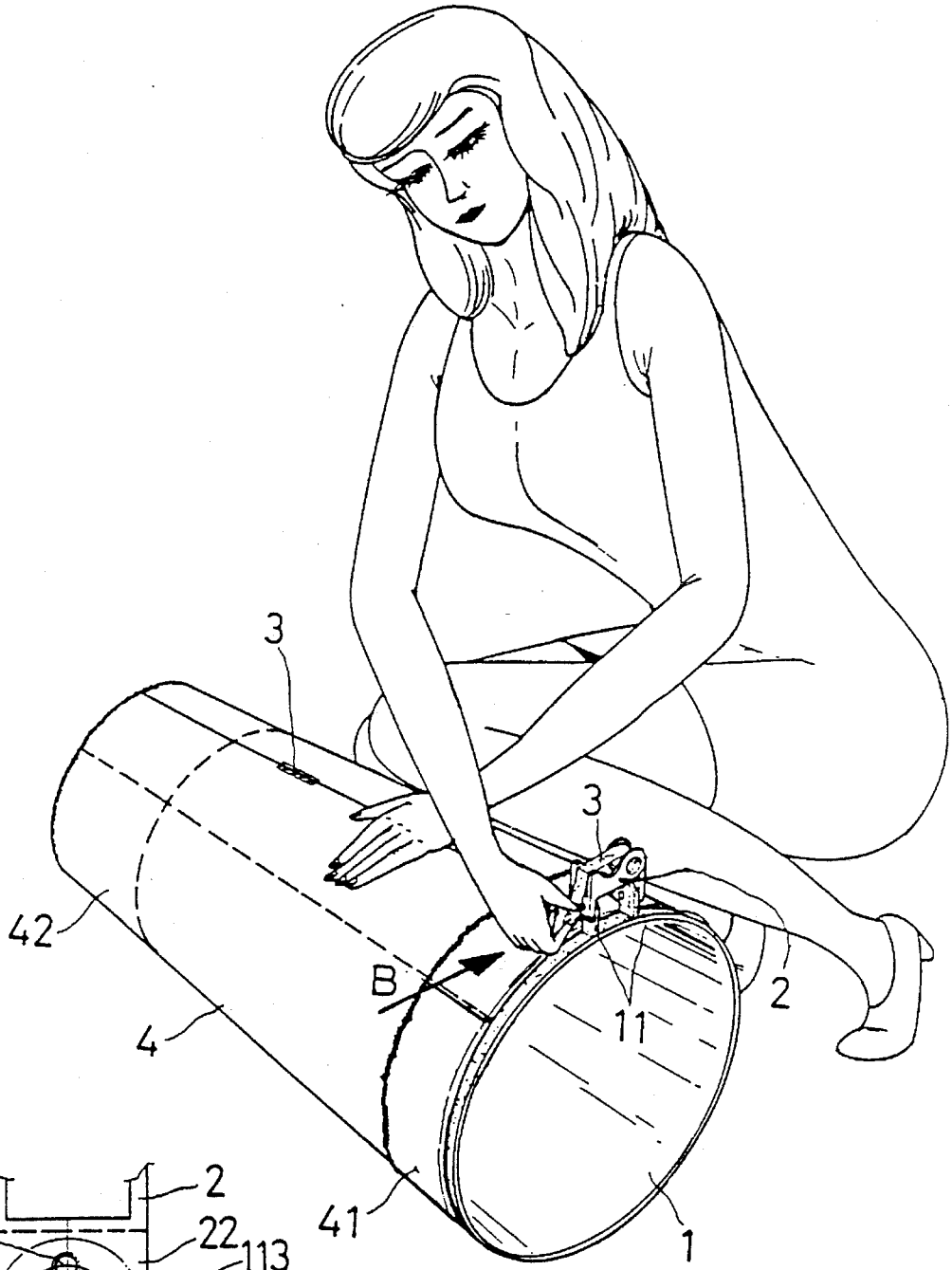
FIGS. 4, 6, 8 and 9 illustrate the way to make a litter bag from a waste paper sheet.
Figure 5:
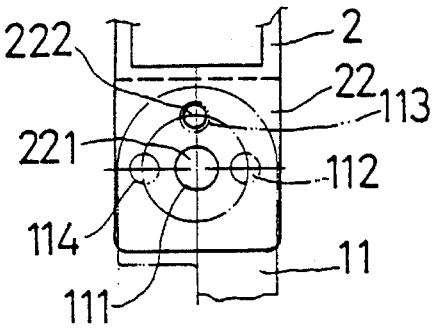
FIGS. 5, 7 and 10 show the engagement between the tape holder and the lugs of the container.
Figure 6:
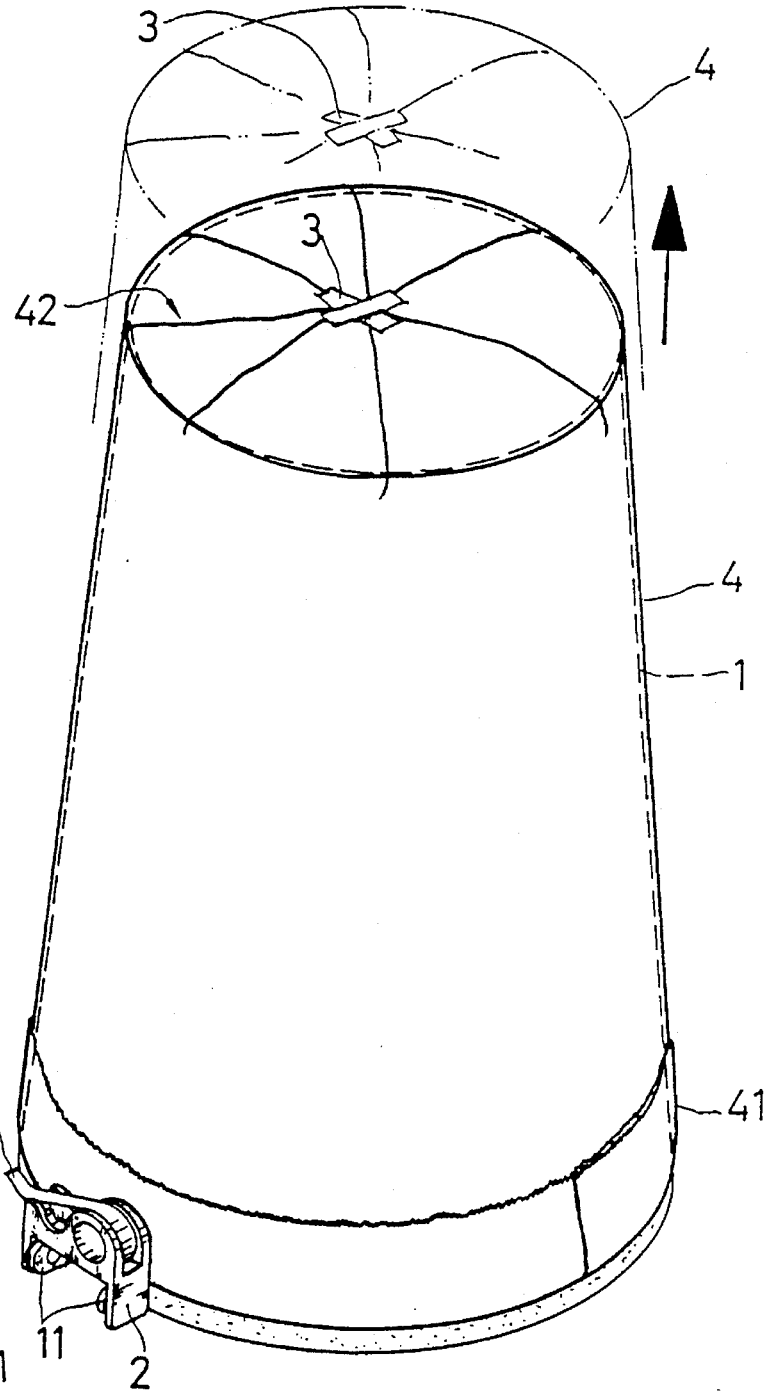
Figure 7:
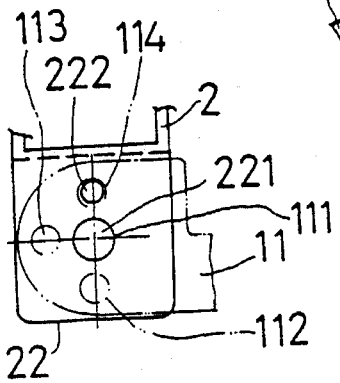
Figure 8:
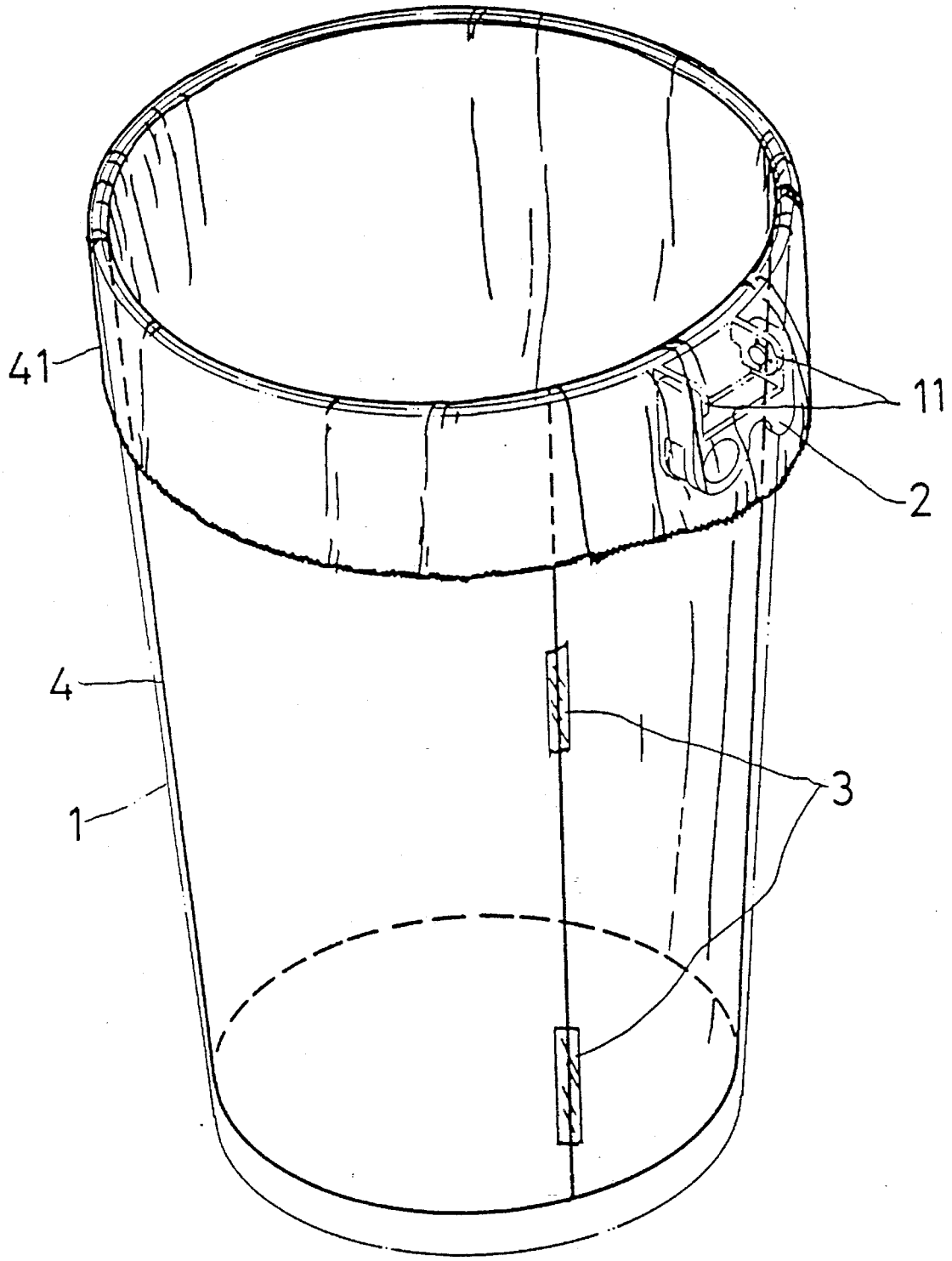

When in use, first fold the upper portion of the waste paper 4 (such as newspaper, catalogue, packaging paper, and recycled paper) downward to form a collar 41 and wrap the paper 4 on the outer surface of the container 1 to form the body of a litter bag (see FIGS. 3 and 4). Then, turn the tape holder 2 to engage its protuberances 222 with container 1 as shown in FIG. 4 thereby enabling the tape 3 to be severed conveniently and cut off a piece of the tape 3 to fix the shape of the litter bag. Thereafter, put the container 1 up side down and turn the tape holder 2 to engage its protuberances 222 with the lower holes 114 of the lugs 11 of the container 1 (see FIGS. 6 and 7) so as to form the bottom 42 of the litter bag. Then, remove the litter bag 4 from the container 1 and insert the litter bag 4 into the container 1 with its collar 41 enclosing the lugs 11 and the tape holder 2 (see FIG. 8). Thereafter, turn the tape holder 2 to engage its protuberances 222 with the upper holes 112 of the lugs 11 of the container 1 and cut off a piece of tape 3 to close the mouth of the litter bag (see FIGS. 9 and 10).

Figure 11:
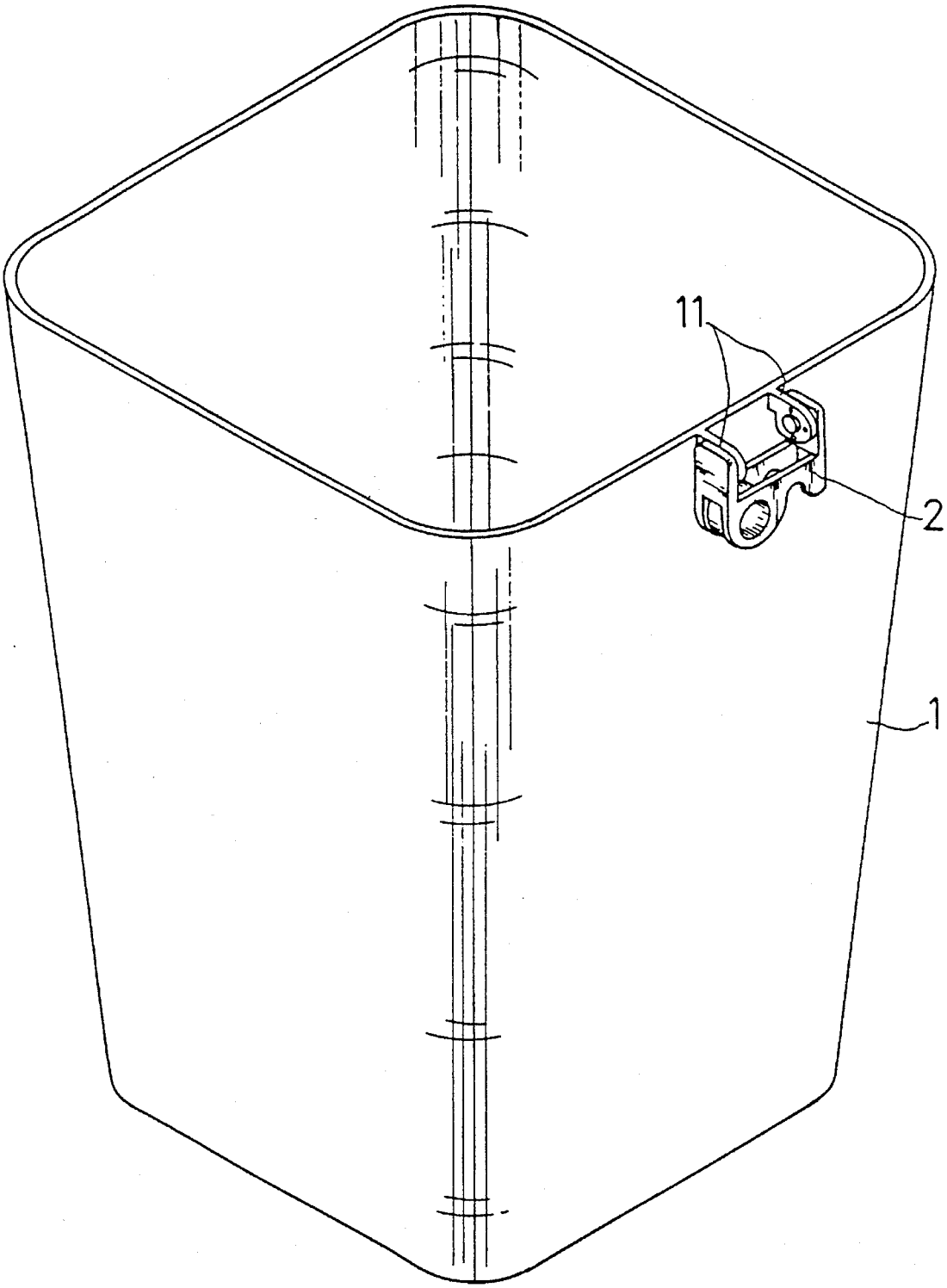
FIG. 11 shows a second preferred embodiment of the present invention.
Figure 12:
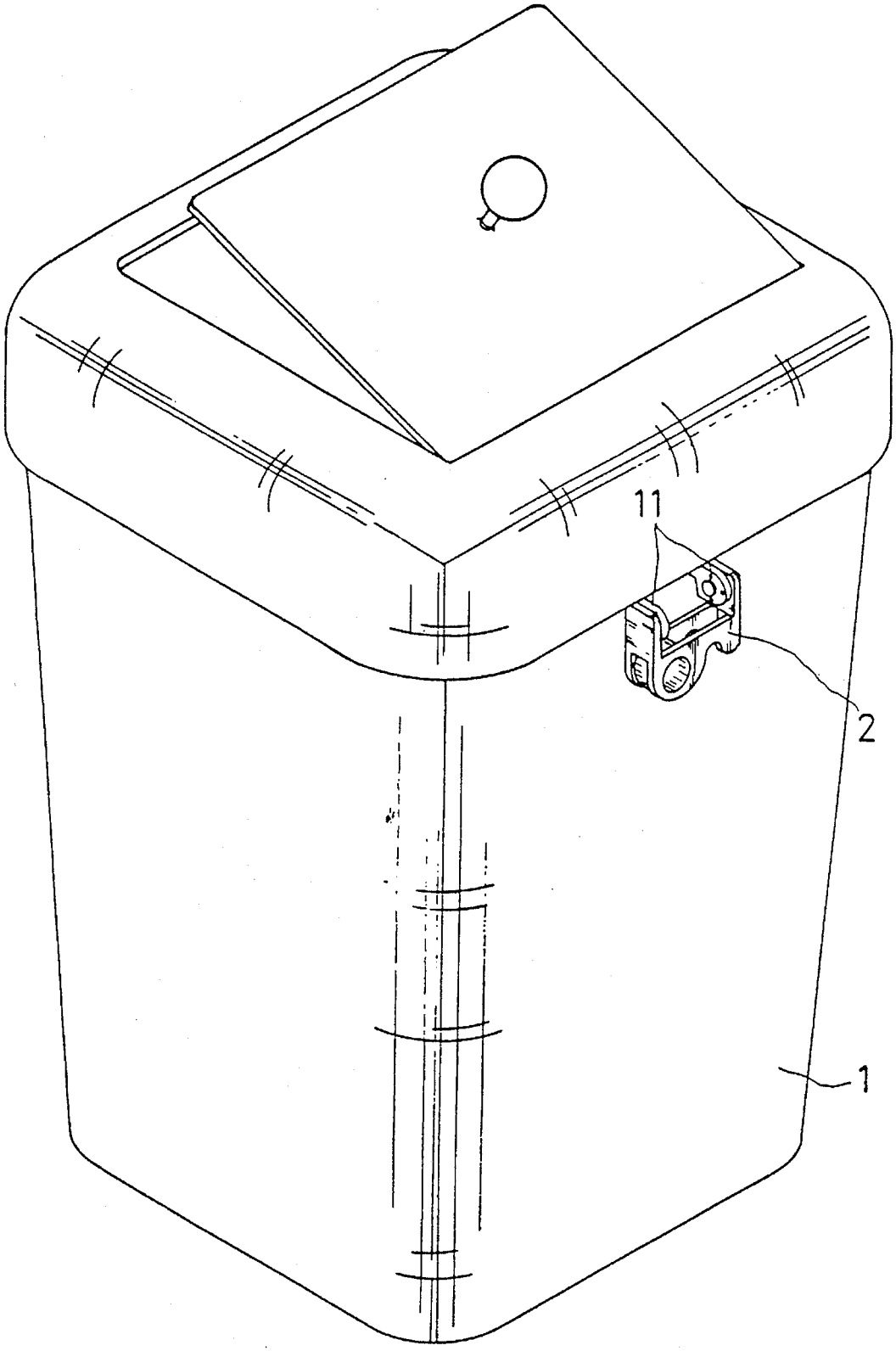
FIG. 12 shows a third preferred embodiment of the present invention.
Figure 13:
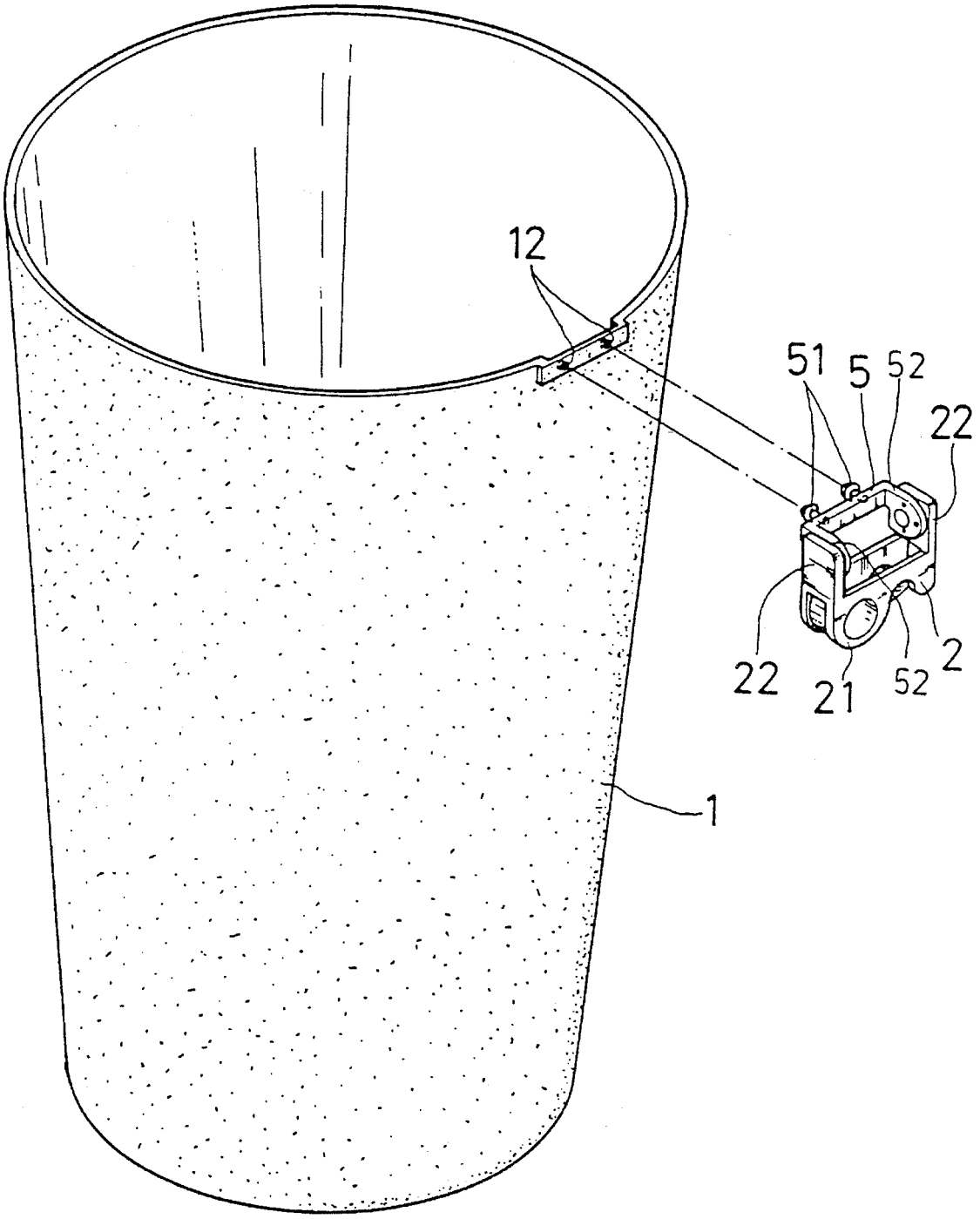
FIG. 13 shows a fourth preferred embodiment of the present invention.

FIGS. 11, 12 and 13 illustrate different embodiments of the present invention. As shown in FIG. 13, the lugs 11 are replaced with a U-shaped member 5 having two lugs 52 and fixedly mounted on the container 1 by taper pins 51 extending through the holes 12 of the container 1.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A litter bin comprising:

a container formed with a pair of lugs each having a center opening, an upper hole above the center opening, a lower hole below the center opening, and an intermediate hole located between said upper hole and said lower hole and at an outer side of said center opening; and a tape holder having a pair of upwardly extending arms and a seat at a lower portion, said arms each having a cylindrical portion engaging the center opening of each of said lugs and a protuberance located under the cylindrical portion and engageable with the upper hole, the intermediate hole and the lower hole of each of said lugs.

2. The litter bin as claimed in claim 1, wherein said lugs being engaged with said container by taper pins.

* * * * *